US009476582B2

(12) United States Patent
Abeyta

(10) Patent No.: US 9,476,582 B2
(45) Date of Patent: Oct. 25, 2016

(54) SYSTEM AND METHOD FOR REMOVING SLAG INSIDE A UTILITY FURNACE

(71) Applicant: Christopher L. Abeyta, Farmington, NM (US)

(72) Inventor: Christopher L. Abeyta, Farmington, NM (US)

(73) Assignee: POWER & CONTROL SOLUTIONS, INC., Farmington, NM (US)

( * ) Notice: Subject to any disclaimer, the term of this patent is extended or adjusted under 35 U.S.C. 154(b) by 79 days.

(21) Appl. No.: 14/040,411

(22) Filed: Sep. 27, 2013

(65) Prior Publication Data

US 2014/0026827 A1 Jan. 30, 2014

Related U.S. Application Data

(63) Continuation of application No. 12/636,446, filed on Dec. 11, 2009, now abandoned.

(51) Int. Cl.

| | |
|---|---|
| ***F28G 3/16*** | (2006.01) |
| ***F28G 1/16*** | (2006.01) |
| ***F28G 9/00*** | (2006.01) |
| ***F22B 37/54*** | (2006.01) |

(52) U.S. Cl.

CPC ..... *F22B 37/545* (2013.01); *F22B 37/54* (2013.01); *F28G 1/16* (2013.01); *F28G 3/16* (2013.01); *F28G 9/00* (2013.01)

(58) Field of Classification Search

CPC ..... F28G 3/16; F28G 9/00; F28G 1/16; F22B 37/545; F22B 37/54

USPC ..... 239/8, 461, 566, 750, DIG. 13, 752; 15/316.1

See application file for complete search history.

(56) References Cited

U.S. PATENT DOCUMENTS

| | | | | |
|---|---|---|---|---|
| 860,523 | A | | 7/1907 | Canales |
| 1,377,622 | A | | 5/1921 | Kemnal et al. |
| 1,529,055 | A | | 3/1925 | Dorsey |
| 1,652,845 | A | | 12/1927 | Vennum |
| 2,897,532 | A | | 8/1959 | Cantieri |
| 3,221,994 | A | | 12/1965 | Chappell |
| 3,234,580 | A | * | 2/1966 | Keck ..... F28G 1/16 110/192 |
| 3,439,376 | A | | 4/1969 | Nelson et al. |
| 3,817,722 | A | * | 6/1974 | Scott ..... 44/320 |
| 3,837,820 | A | * | 9/1974 | Kukin ..... 431/2 |
| 4,229,854 | A | | 10/1980 | Johnston, Jr. |
| 4,368,677 | A | | 1/1983 | Kline |
| 4,421,067 | A | | 12/1983 | Krowech |

(Continued)

FOREIGN PATENT DOCUMENTS

| | | |
|---|---|---|
| CA | 2467550 A1 | 11/2005 |
| CN | 2225599 | 4/1996 |

(Continued)

OTHER PUBLICATIONS

USPTO; Notice of Publication mailed Mar. 26, 2015 in corresponding U.S. Appl. No. 14/562,276.

(Continued)

*Primary Examiner* — Arthur O Hall
*Assistant Examiner* — Chee-Chong Lee
(74) *Attorney, Agent, or Firm* — Snell & Wilmer L.L.P.

(57) ABSTRACT

This disclosure may relate generally to systems, devices, and methods for injecting a solid compound in line with a pressurized fluid, typically through a soot blower, to be delivered to targeted areas on the inside of a utility furnace.

10 Claims, 8 Drawing Sheets

(56) References Cited

U.S. PATENT DOCUMENTS

| | | | | |
|---|---|---|---|---|
| 4,456,635 | A | 6/1984 | Albanese et al. | |
| 4,545,411 | A | 10/1985 | Wierzba et al. | |
| 4,616,574 | A * | 10/1986 | Abrams et al. | 110/343 |
| 4,996,032 | A * | 2/1991 | Stowe et al. | 423/243.09 |
| 5,355,844 | A | 10/1994 | Kendrick | |
| 5,585,072 | A | 12/1996 | Moskel et al. | |
| 6,289,827 | B1 * | 9/2001 | Wajer et al. | 110/345 |
| 6,363,869 | B1 | 4/2002 | Ashworth | |
| 2004/0018133 | A1 * | 1/2004 | Radway | 423/244.05 |
| 2005/0063887 | A1 | 3/2005 | Arrol et al. | |
| 2006/0121398 | A1 | 6/2006 | Meffert et al. | |
| 2007/0119351 | A1 | 5/2007 | Widmer et al. | |
| 2007/0119352 | A1 | 5/2007 | Martin et al. | |
| 2009/0047199 | A1 | 2/2009 | Arrol et al. | |
| 2010/0263577 | A1 * | 10/2010 | Nijhawan | 110/345 |
| 2011/0132282 | A1 | 6/2011 | Abeyta | |
| 2012/0247405 | A1 | 10/2012 | Abeyta | |

FOREIGN PATENT DOCUMENTS

| | | | |
|---|---|---|---|
| CN | 101319861 | | 12/2008 |
| WO | 2004105928 | A2 | 12/2004 |
| WO | 2010119177 | A2 | 10/2010 |
| WO | 2011072222 | | 6/2011 |

OTHER PUBLICATIONS

USPTO; Notice of Publication mailed Apr. 2, 2015 in corresponding U.S. Appl. No. 14/563,648.

Watts, J.U., Mann, A.N. and Russell, Sr., D.L., "An Overview of NOx Control Technologies Demonstrated under the Department of Energy's Clean Coal Technology Program," American Institute of Chemical Engineers Conference, New Orleans, LA, Mar. 1998.

USPTO; Notice of Publication mailed Jun. 9, 2011 in corresponding U.S. Appl. No. 12/636,446.

WIPO; International Search Report and Written Opinion mailed Aug. 23, 2011 in corresponding International Application No. PCT/US2010/059886.

USPTO; Restriction Requirement mailed Feb. 29, 2012 in corresponding U.S. Appl. No. 12/636,446.

WIPO; International Preliminary Report on Patentability mailed Jun. 21, 2012 in corresponding International Application No. PCT/US2010/059886.

USPTO; Office Action mailed Aug. 16, 2012 in corresponding U.S. Appl. No. 12/636,446.

USPTO; Notice of Publication mailed Oct. 4, 2012 in U.S. Appl. No. 13/492,479.

USPTO; Office Communication mailed Jan. 24, 2013 in corresponding U.S. Appl. No. 12/636,446.

USPTO; Office Action mailed Jun. 28, 2013 in corresponding U.S. Appl. No. 12/636,446.

USPTO; Office Action mailed Dec. 4, 2014 in corresponding U.S. Appl. No. 13/492,479.

WIPO; International Preliminary Report on Patentability mailed Dec. 9, 2014 in corresponding International Application No. PCT/US2013/044296.

International Search Report and Written Opinion dated Dec. 6, 2013 in PCT/US2013/044296.

USPTO; Final Office Action mailed Jul. 31, 2015 in corresponding U.S. Appl. No. 13/492,479.

USPTO; Notice of Allowance mailed Feb. 18, 2016 in corresponding U.S. Appl. No. 13/492,479.

EPO; Supplementary Extended European Search Report mailed May 13, 2016 in corresponding European Application No. 13800964.2.

USPTO; Advisory Action mailed Oct. 9, 2015 in corresponding U.S. Appl. No. 13/492,479.

USPTO; Applicant-Initiated Interview Summary mailed Oct. 15, 2015 in corresponding U.S. Appl. No. 13/492,479.

Office Action dated May 6, 2016 in Chinese Application No. 201380042144.7.

* cited by examiner

SYSTEM AND METHOD FOR REMOVING SLAG INSIDE A UTILITY FURNACE

CROSS-REFERENCE TO RELATED APPLICATION

This application is a continuation of and claims priority to U.S. Ser. No. 12/636,446 filed on Dec. 11, 2009, and entitled SYSTEM AND METHOD FOR INJECTING COMPOUND INTO UTILITY FURNACE, which is incorporated herein by reference in its entirety.

FIELD OF INVENTION

The subject of this disclosure may relate generally to systems, devices, and methods for facilitating the injection of various compounds into a utility furnace.

BACKGROUND OF THE INVENTION

Utility furnaces are used in various industries for a variety of different purposes. Common issues associated between these various industries include the handling of the byproducts created by the combusted fuel. These byproducts can decrease the utility furnace efficiency and pose other pollution problems.

In one example, the pulverized coal, used in various types of boilers, burns in a combustion chamber. The hot gaseous combustion products then follow various paths, giving up their heat to steam, water and combustion air before exhausting through a stack. The boiler is constructed mainly of interconnected elements such as cylinders such as the super heater tubes, water walls, various larger diameter headers, and large drums. Water and steam circulate in these elements, often by natural convection, the steam finally collecting in the upper drum, where it is drawn off for use. Water/steam tubes typically almost completely cover the walls of the passage so that they efficiently transfer heat to the water/steam. As the coal is burned, ash and/or other products of combustion build-up on the tubes.

Presently soot blowers are available to aid in the removal of these build-ups. Soot blowers are mechanical devices used for on-line cleaning of ash and slag deposits on a periodic basis. They direct a pressurized fluid through nozzles into the soot or ash accumulated on the heat transfer surface of boilers to remove the deposits and maintain the heat transfer efficiency. The soot and dust generated in combustion get deposited on outer tube surfaces. This adds to the fuel requirements to maintain utility furnace temperatures. Running with added fuel in turn increases deposition of byproducts of fuel burning and also increases the chances of the tubes failure by overheating. This eventually results in shutting down of the furnace for repairs. All this can be avoided by soot blowing. Regular soot blowing saves fuel and boiler downtime. In other words steam at constant parameters is available over a longer period of time. Numerous types of soot blowers exist including but not limited to wall soot blowers, long retractable soot blowers, rotating element soot blowers, helical soot blowers, and Rake-type blower. Under optimal conditions this ash is removed from the surface of the tubes by pressured fluid (typically air, saturated steam or super-heated steam) delivered soot blowers. However under suboptimal conditions the ash melts due to reaching its fusion temperature and results in the formation of slag. Soot blowers are less effective at removing the slag.

The major problem with the formation of slag is that it insulates the elements, thus requiring the furnace to burn at a hotter temperature to create the same increase in water temperature. Excessive ash deposits on a coal-fired boiler's heat transfer surfaces will reduce its efficiency, and in extreme cases a boiler can be shut down by ash-related problems. Slagging incidents are a heavy drag on the global utility industry due to reduced power generation and equipment maintenance.

The changing electricity market and political pressures have pushed the use of fuels other than coal. For example, use of gas, biofuel, co-fired fuel, etc., has become widespread. These factors have led to coal-fired plants being operated under unusual loads. This change in operation has altered the effects of boiler slagging. The co-firing of other fuels with coal, especially biomass, represents a large challenge to utility furnace operation. The ash chemistry of these alternative fuels is often very different to that of the coals and has given rise to serious problems. The tendency of coal for slagging depends on its composition. The complex interaction between a boiler's operating conditions and the fuel chemistry makes the prediction of slagging difficult. Furthermore, the increasing pressure on coal-fired power stations to reduce emissions has led to the development of technologies for the abatement of specific pollutants that impact on ash slagging. The new generation of pulverized coal fired plant, designed for high efficiency through the use of high steam temperatures and pressures, present further challenges with respect to ash slagging and fouling.

Various methods of removing the slag other than with a soot blower are in use. For example in some power plants, engineers fire shotguns into the furnace to break the slag off of the pipes. Other methods require taking the furnace off line to deal with the problem. These techniques are less than satisfactory, and neither of these solutions address issues of pollution.

In dealing with the byproducts released into the environment (pollution), various systems associated with the utility furnaces process the byproducts before their release. However, better methods of chemical processing of these byproducts are constantly sought after. New utility furnaces are almost certain to be required to operate under conditions that facilitate carbon capture and storage, for compliance with climate change driven requirements. While such requirements are frequently sought in relation to coal fired furnaces they could also apply to a variety of fuel types.

While the problems and limitations of utility furnaces are clear, there are few solutions. The presence of certain compounds in the utility furnaces have been experimented with and resulted in improved abilities to deal with slag and pollution. While the specific compounds vary across the board depending on the specific chemistry of the fuel and problem to be addressed, one uniform problem exists, there is no adequate delivery mechanism to inject the compounds into targeted spots in the furnace.

A solution to the problem of delivering various compounds to targeted locations of a utility furnace is needed. As such a solution to the delivery of compounds into a utility furnace is presented herein.

SUMMARY OF THE INVENTION

In accordance with various aspects of the present invention an apparatus comprises a nozzle configured to receive a compound, wherein the nozzle is further configured to mix the compound with a fluid.

In another exemplary embodiment, a system comprises a fluid supply configured to deliver a fluid; a valve connected to the fluid supply wherein the valve is operable to control the fluid from the fluid supply; a feed tube configured to connect to the valve and transport the fluid; a delivery device configured to connect to the feed tube and configured to eject the fluid into a utility furnace; a solid agent capable of improving the efficiency of the utility furnace; a hopper configured to hold a quantity of the solid agent; an auger connected to the hopper and operable to transfer solid agent from the hopper; and a nozzle operable to receive the solid agent from the auger and combine the solid agent with the fluid supply wherein, the nozzle is configured to be removably connected to the valve.

Furthermore, in an exemplary embodiment a method comprises attaching a nozzle in-line with a fluid supply; delivering a solid agent to the nozzle mixing the solid agent with the fluid supply forming a mixture; and delivering the mixture to a utility furnace.

BRIEF DESCRIPTION OF THE DRAWINGS

These and other features, aspects, and advantages will become better understood with reference to the following description, claims and accompanying drawings where:

DETAILED DESCRIPTION

In accordance with an exemplary embodiment of the present invention, systems, devices, and methods are provided, for among other things, facilitating the injection of various compounds into a utility furnace. The following descriptions are not intended as a limitation on the use or applicability of the invention, but instead, are provided merely to enable a full and complete description of exemplary embodiments.

Figure 2:
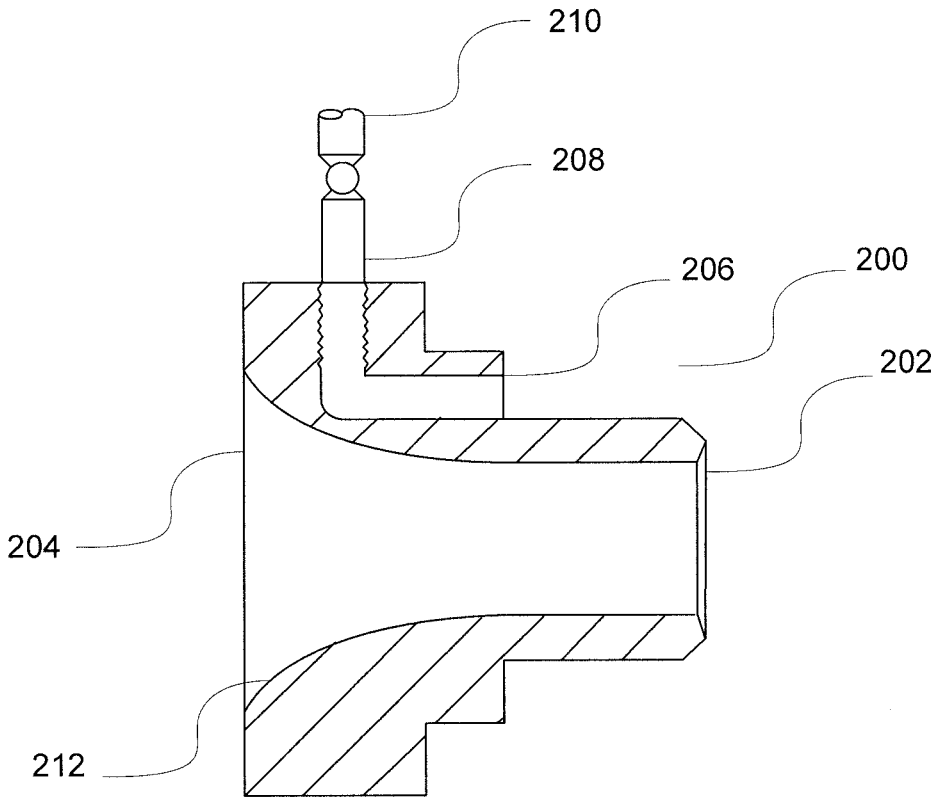
FIG. 2 is a cross section of an exemplary embodiment of a nozzle used to mix various compounds and pressurized fluid.

In accordance with an exemplary embodiment, with reference to FIG. 2, nozzle 200 may have a first side 204, an inlet side to the fluid, and a second side 202, an exit side to the fluid. Nozzle 200 may be variously sized to accommodate the equipment that it mates to. In one exemplary embodiment nozzle 200 may be approximately 1-3 inches in diameter at the outlet to accommodate common feed tube sizes used with utility furnaces. However, nozzle 200 can be sized to fit various components. In accordance with one embodiment, nozzle 200 may have a varying cross-section between the first side and the second side. In various embodiments, the varying cross-section of the nozzle may comprise a long radius 212. The long radius may have its largest opening in the nozzle on first side 204 and the smallest diameter cross-section on second side 202. In accordance with an exemplary embodiment, nozzle 200 comprises a varying the cross section that causes a high pressure on first side 204 relative to a low pressure on the second side 202.

The nozzle may also have a compound entrance 208. In an exemplary embodiment, the compound may be brought into nozzle 200 via compound entrance 208. Nozzle 200 may also have a compound exit 206. In an exemplary embodiment the compound exits nozzle 200 via compound exit 206. In accordance with an exemplary embodiment of the present invention, nozzle 200 may be configured for the mixing a compound with a pressurized fluid stream.

In various embodiments of the present invention, the nozzle may further comprise a valve 210. One exemplary embodiment, valve 210 may be a ball valve. In another exemplary embodiment, valve 210 may be a gate valve. Valve 210 may control the flow of the compound. In accordance with various embodiments of the present invention, the flow of the incoming compound may be stopped and started by opening and closing valve 210. In other exemplary embodiments, the valve may prevent the compound from flowing away from nozzle 200 and only allow the compound to flow into nozzle 200.

Figure 3:
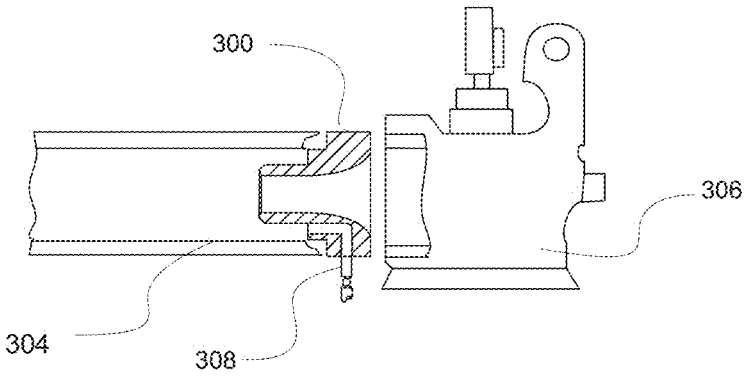
FIG. 3 is cross section of an exemplary embodiment of an apparatus for mixing a compound with a pressurized fluid.

In accordance with an exemplary embodiment of the present invention, an apparatus for mixing a compound with a pressurized fluid stream comprises a nozzle, a valve, and a feed tube. In this embodiment, referring to FIG. 3, nozzle 300 may be positioned between valve 306 and feed tube 304. The pressurized fluid can pass through nozzle 300 coming from valve 306 and flowing into feed tube 304. Furthermore, nozzle 300 may be configured to receive the compound at entrance 308 and mix the compound with the pressurized fluid stream.

In various exemplary embodiments nozzle 300 may include features which allow for the connection of nozzle 300 to valve 306 or to feed tube 304. Such features might include any of a variety of fasteners known in the industry e.g., bolts, weld, pressure fittings, bracketed flanges, etc. In other various embodiments nozzle 300 may be an integral or integrated part of valve 306 or feed tube 304. For example nozzle 300 and feed tube 304 may be manufactured as one piece. In an alternate example valve 306 and nozzle 300 maybe manufactured as one piece. Likewise, all three elements may be manufactured as one piece.

In one exemplary embodiment, valve 306 is a poppet valve. In other embodiments valve 306 is any of a variety of valves include but not limited to diaphragm valves, pressure regulator valves, check valves, etc. In various embodiments of the present invention valve 306 can be any of a variety of valves used in the art whereby the valve controls the flow of fluid. Furthermore, valve 306 may be configured to adjust the pressure of the fluid passing through.

As discussed above, the apparatus may further comprise feed tube 304. In various embodiments of the present invention, feed tube 304 may be configured to attach directly to either valve 306 or nozzle 300. In an exemplary embodiment feed tube 304 may be configured to be detached from valve 306 and attached to nozzle 300 inserted between feed tube 304 and valve 306. In this manner, an existing device may be retrofitted to include the nozzle 300. As discussed above the feed tube may also be integrated with nozzle 300 and/or valve 306. In various embodiments, feed tube 304 may be configured to withstand the pressure and corrosion caused by any material flowing through it. In various examples, fluid may flow through the feed tube at 300 SCFM to 1000 SCFM. However, depending on the application smaller or larger rates may be used. The feed tube may be comprised of hardened steel that is capable of withstanding the mixture of the high pressure fluid and also the compound introduced at nozzle 300. Further, other various materials may be used depending on the intended use of the system. In some instances the feed tube may be a component already installed in a facility incorporating the apparatus.

In one exemplary embodiment of the present invention, the compound introduced at nozzle 300 may be any of a variety of solids, liquids, or gases that may beneficially be injected into a utility furnace. Furthermore, the compounds should be configured such that they are capable of being transported in line through a pressure system. In various examples the compound may be caused to move through the system via a positive pressure or a negative pressure.

In accordance with an exemplary embodiment, a compound in solid form may be sufficiently granular that it can pass through various types of tubing. In one exemplary embodiment, the compound may be a solid agent or a dry compound, being a substantially dry, granular solid having insignificant levels of humidity or liquid. However, in various other embodiments of the present invention, the compound may be a slurry, liquid, or gas. Various examples of compounds used in the system may include, but are not limited to, magnesium hydroxide, potassium hydroxide, sodium hydroxide, aluminum hydroxide, magnesium, kaolin, mullite and/or dry urea-based solids. Any such compound that may be desirable for a variety of chemically reactive, cleaning, processing or other beneficial purposes inside of a utility furnace may also be incorporated.

In one exemplary embodiment of the present invention, the fluid comprises pressurized air. In other various embodiments the fluid might comprise steam. Moreover, the fluid may comprise any compressed or pressurized fluid capable of being projected through the system.

Figure 4:
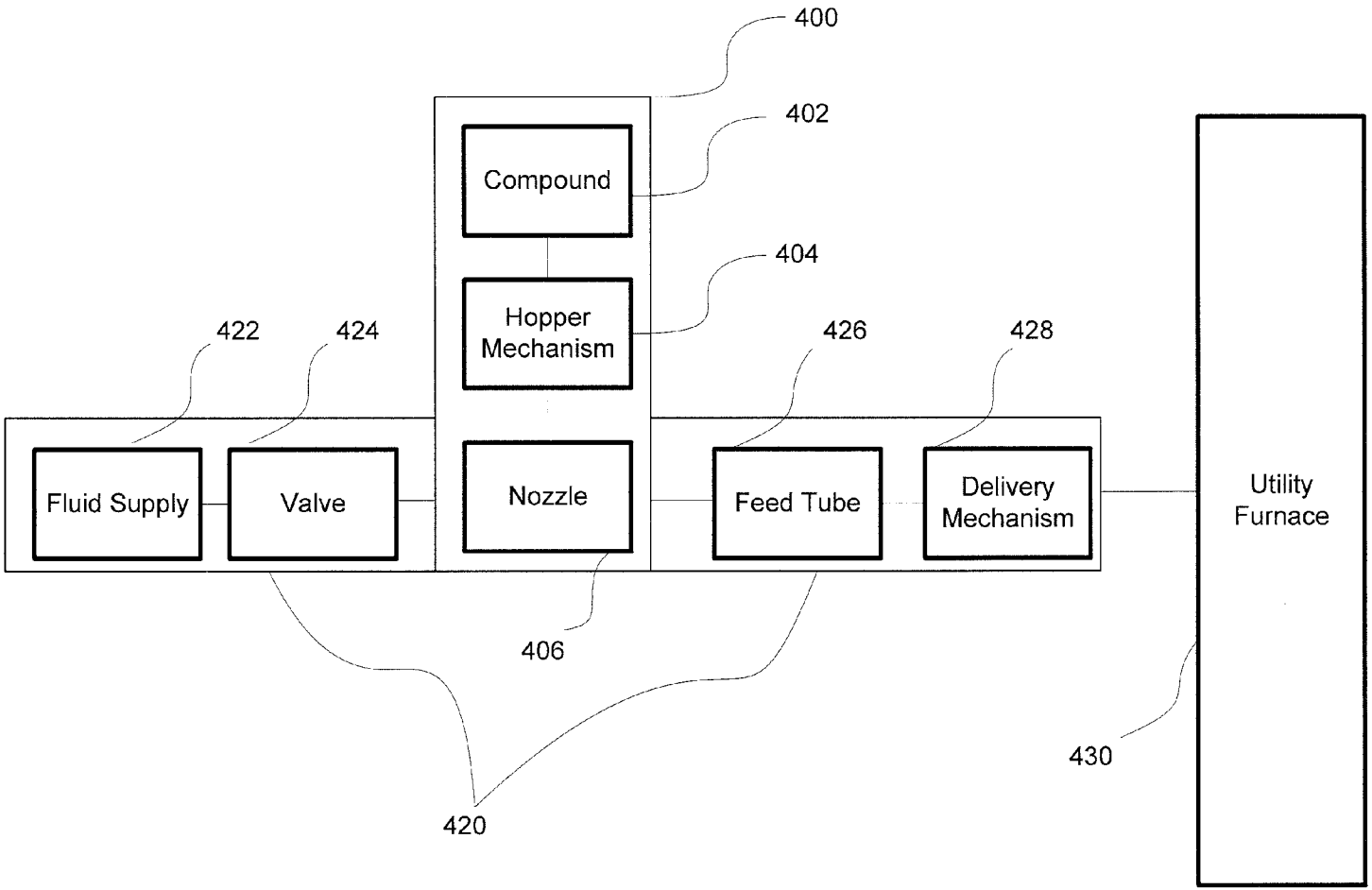
FIG. 4 is an exemplary embodiment of a flow process of the system.

In accordance with an exemplary embodiment of the present invention, the apparatus for mixing a compound with a pressurized fluid stream (comprising a nozzle, a valve, and a feed tube) may be used or adapted to a utility furnace. In an exemplary embodiment, and with reference to FIG. 4, the apparatus may also be incorporated into a larger system wherein the system comprises compound feed mechanism 400 which comprises solid agent 402, compound storage 404, and nozzle 406, coupled in-line with fluid delivery system 420 which comprises fluid supply 422, valve 424, feed tube 426 and delivery mechanism 428 either removable or permanently coupled to utility furnace 430.

The fluid, as contemplated in an exemplary embodiment of the system, may comprise any of a steam, air or other compressed gasses or fluids typically released in a utility furnace. In accordance with an exemplary embodiment the fluid supply may be an air compressor, steam recirculation system, pump, pressure vessel, etc. Furthermore, the fluid supply may be any commercially available mechanism capable of creating, maintaining, or adjusting these pressures as contemplated herein. The fluid supply may be positioned and/or coupled to valve 424 directly or by means of other connections and/or devices.

Figure 6:
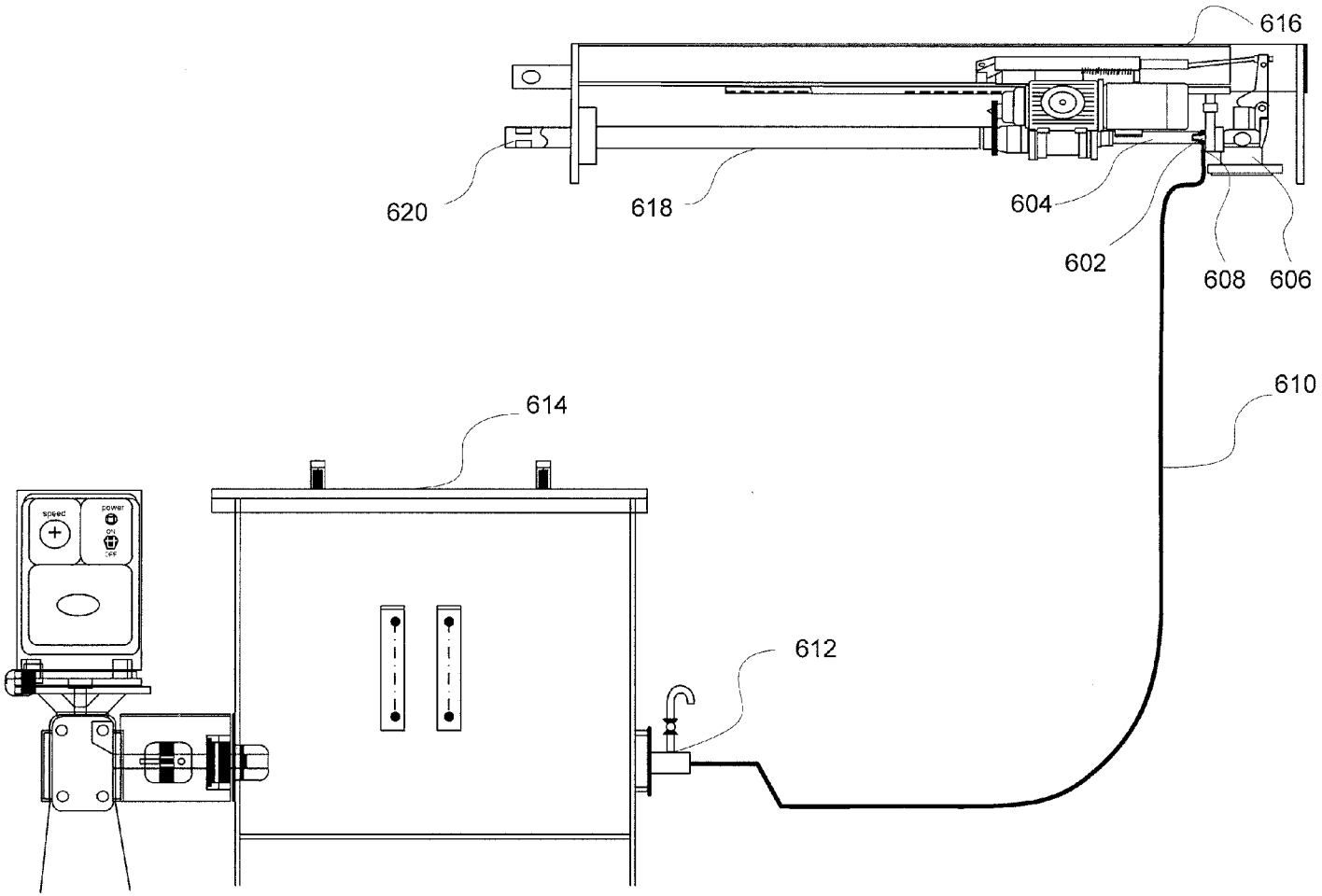
FIG. 6 is an exemplary embodiment of a system as part of a retractable soot blower.
Figure 7:
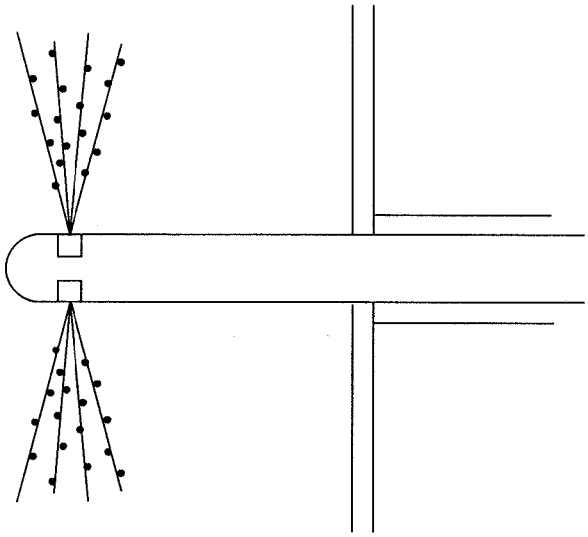
FIG. 7 is an exemplary embodiment of distribution of a compound from a soot blower.
Figure 8:
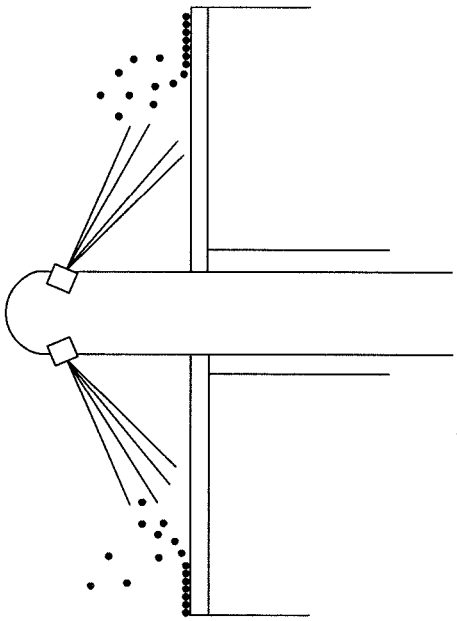
FIG. 8 is an exemplary embodiment of a compound from a wall mounted soot blower.

In accordance with an exemplary embodiment of the present invention, referring to FIG. 6, the delivery mechanism may be lance 618 and/or injection nozzle 620. In another exemplary embodiment, the delivery mechanism comprises the injection nozzle associated with a wall blower. In various exemplary embodiments, the delivery mechanism may be any permanent or temporary fixture on the utility furnace. In various exemplary embodiments of the present invention, a delivery mechanism is any component capable of delivering the pressurized fluid and/or mixture compound into a utility furnace. In one exemplary embodiment, lance 618 may be capable of being inserted partially or fully into a utility furnace. The lance tube is what is carried and rotated into the furnace by a gearbox/motor attached to the soot blower. The lance tube may surround the stationary feed tube and is sealed by a gland. In another exemplary embodiment, injection nozzle 620 is configured to deliver the fluid supply and/or the fluid supply compound mixture to specific locations inside the utility furnace, such as to a wall as depicted in FIG. 8 or out into an open chamber as depicted in FIG. 7. Thus, the compound can be delivered to the exhaust gas, exhaust chamber, combustion chamber, water walls, pipes, superheat tubes, the back pass, or any other element in a utility furnace or its exhaust gas stream.

With reference to the compound, as discussed above, the compound may be received by the nozzle. This compound may be stored in any of a variety devices connected to the nozzle. In accordance with an exemplary embodiment, and with reference to FIG. 5, a compound storage 514 may comprise a hopper with an auger feeder connected either directly or indirectly to nozzle 502. In one exemplary embodiment, the compound is stored in a nonpressurized hopper. In accordance with various other exemplary embodiments, the compound may be stored and delivered by pressurized vessels, gravity feed, pumps, conveyors or any commonly known apparatus capable of delivering the compound to the inlet of the nozzle.

Various quantities of this compound may be incorporated in the use and functionality of the system herein discussed. In one exemplary embodiment, upwards of 1000 lbs. of compound per cleaning cycle may be injected into a utility furnace for the removal of soot. However, the quantities can vary depending on the size of the utility furnace and purpose for which the compound is being injected.

While the compound can be delivered and/or received by the nozzle in a variety of ways as discussed previously, the motivation through the nozzle can also occur in a variety of ways. In accordance with an exemplary embodiment of the present invention, a vacuum may be present on the second side of nozzle 200 which may create a force which may draw sufficient amounts of compound into the fluid stream to be delivered with the system. In one exemplary embodiment, nozzle 200 may cause 60 inches of vacuum (i.e., a drop in pressure expressed in inches of water). In various other embodiments the vacuum can be greater or less than 60 inches of water depending on the application. Variations on the profile of the nozzle can be optimized to produce a sufficient vacuum. In other various embodiments, the compound itself may be pressurized and introduced into the fluid stream by that pressure. Such pressurization can occur in any way typical of the art including, but not limited to the forces created by the devices discussed above.

Referring again to FIG. 4, and in an exemplary embodiment, fluid delivery mechanism 420 as discussed above can be incorporated to deliver at least a pressurized fluid flow into utility furnace 430. In one exemplary embodiment, the utility furnace is a coal fired induction draft power plant furnace. Moreover, a utility furnace may be any of a commercially available or custom furnaces including but not limited to boilers, HVAC, cokers, pulp and paper furnaces, etc. In an exemplary embodiment the furnace may be any of a variety of boilers fired by a variety of fossil fuels including, but not limited to, coal, petroleum, natural gas, etc. In other various embodiments of the present invention, a utility furnace might include any of a variety of boilers fired by alternative fuels, such as, for example, bio fuels or a combination of bio fuels and fossil fuels. In various exemplary embodiments of the present invention, utility furnaces might incorporate or include furnaces used in a variety of industries including metal refineries, (e.g., cokers), pulp and paper, energy production, waste disposal, heating, etc.

Figure 1:
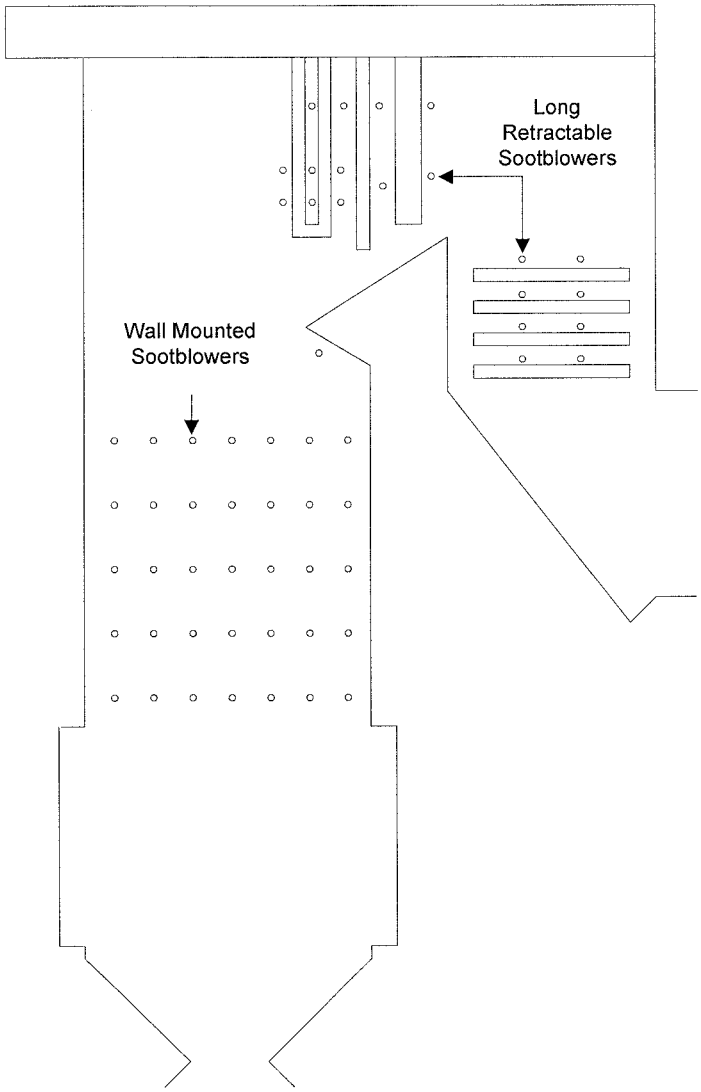
FIG. 1 is an exemplary utility furnace depicting soot blower locations.

Referring to FIG. 1, soot blowers can be located in numerous locations around a furnace. Variations in numbers and locations depend on the size and type of furnaces. Each location may be specifically targeted to allow access to particular elements or locations inside of the furnace. In an exemplary embodiment, these strategically located soot blowers can be used to deliver compound into the furnace. For example, wall mounted soot blowers may be located in the primary combustion area of the furnace. Also, retractable long lance type soot blowers may be located in the superheater or back pass portions of the furnace. In accordance with various other exemplary embodiments, a utility furnace may have various types of soot blowers located near superheaters, reheaters, convection section of horizontal tubes, the economizer and/or air preheaters.

Figure 5:
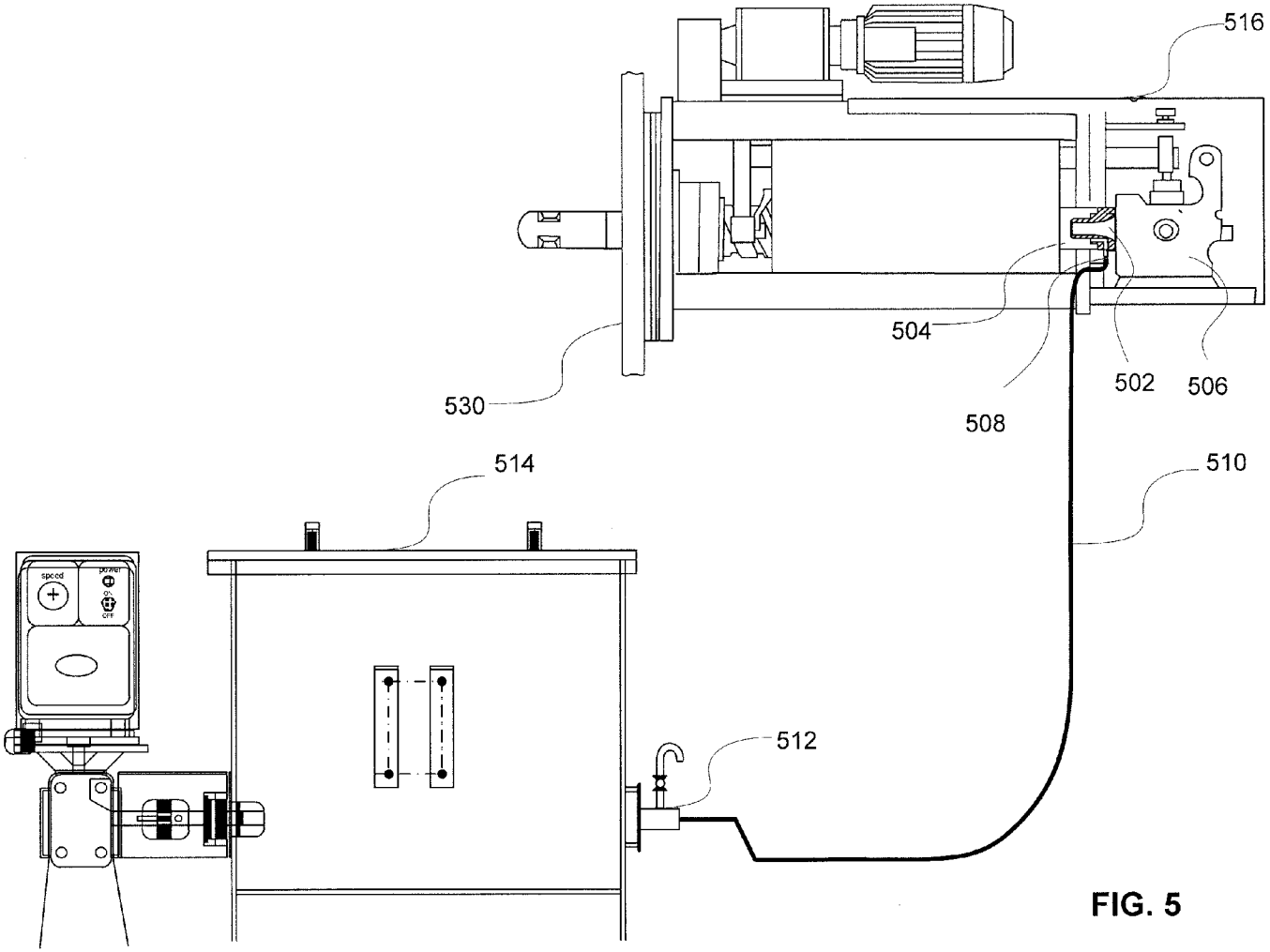
FIG. 5 is an exemplary embodiment of a system as part of a wall mounted soot blower.

In an exemplary embodiment of the present invention, and with reference to FIG. 5, a coal fired furnace system may comprise wall mounted soot blowers 516. Wall mounted soot blower 516 may, for example be a Diamond Power Model IR-3Z soot blower or a Clyde Bergemann Model RW5E. Furthermore, wall mounted soot blower 516 may comprise any device configured to deliver fluid to the interior walls of a utility furnace.

In an exemplary embodiment, wall mounted soot blower 516 may comprise feed tube 504 and valve 506. In one exemplary embodiment nozzle 502 is inserted between feed tube 504 and valve 506. For example nozzle 502 may be retrofitted into wall mounted soot blower 516. In another example, wall mounted soot blower 516 may be originally constructed with nozzle 502 between feed tube 504 and valve 506. In various exemplary embodiments, nozzle 502 may be a component of a compound feed mechanism 400 which comprises valve 508, feed line 510, transport air valve 512 and compound storage 514. Valve 508 may be coupled to feed line 510. Feed line 510 may be coupled to transport air valve 512. Transport air valve 512 may be coupled to compound storage 514.

In an exemplary embodiment nozzle 502 may receive the compound from compound storage 514 and mix the compound with fluid flowing through wall mounted soot blower 516. Wall mounted soot blower 516 may carry the compound to any of a variety of utility furnaces. Wall mounted soot blower 516 may also deliver the compound to wall 530 or any targeted area of the furnace reachable by wall mounted soot blower 516.

In various other embodiments, transport air valve 512 may also include components capable of attaching pressurized air to feed line 510. For example, transport air valve 512 may also include a flow regulator, an air pressure regulator, and/or a filter. These components may enable transport air valve 512 to function as an air pressure source so that it is possible to add additional transport air to move larger heavier quantities of the compound.

In an exemplary embodiment of the present invention, and with reference to FIG. 6, retractable soot blower 616 may comprise feed tube 604 and valve 606. In one exemplary embodiment nozzle 602 is inserted between feed tube 604 and valve 606. For example nozzle 602 may be retrofitted into retractable soot blower 616. In another example, retractable soot blower 616 may be originally constructed with nozzle 602 between feed tube 604 and valve 606. In various exemplary embodiments, nozzle 602 may be a component of a compound feed mechanism 400 which comprises valve 608, feed line 610, transport air valve 612 and compound storage 614. Valve 608 may be coupled to feed line 610. Feed line 610 may be coupled to transport air valve 612. Transport air valve 612 may be coupled to compound storage 614.

In an exemplary embodiment, nozzle 602 may receive the compound from compound storage 614 and mix the compound with fluid flowing through retractable soot blower 616. In various examples, the soot blower may be a Long Retract Diamond Power Model IK-525 or a Long Retract Clyde Bergemann Model US. Soot blower 616 may comprise any device configured to deliver fluid into the interior of any of a variety of utility furnaces. Specifically, lance 618 and injection nozzle 620 may extend into the interior of a utility furnace. Retractable soot blower 616 may then deliver the compound to, for example, the wall, superheat pipes, or any targeted area of the furnace reachable by retractable soot blower 616.

In various exemplary embodiments of the present invention, the nozzle can be placed in line with any commercially available or custom built soot blower including but not limited to a wall soot blower, long retractable soot blower, rotating element soot blower, helical soot blower, and rake-type blower. The nozzle may be included as a constituent piece of the valve, the feed tube, or a combination of either. Furthermore, the soot blowers may be installed on a furnace before adding the nozzle and compound feed. Alternatively a soot blower can be installed on a furnace after it has been retrofitted with a nozzle.

In accordance with various exemplary embodiments, an apparatus mixes a compound with a pressurized fluid to be delivered into a utility furnace. The mixture of the compound and the pressurized fluid may occur inside the body of the nozzle or may occur as the nozzle delivers the compound and pressurized fluid to the feed tube. The nozzle functions to mix the compound with the pressurized fluid stream. This mixture of pressurized fluid and compound is then delivered into a furnace, either by means of a custom apparatus or commercial apparatus. Any apparatus that functionally delivers the fluid compound mixture to the furnace is contemplated herein.

The compound when introduced into the utility furnace adds a benefit over the already available pressurized fluid. In one exemplary embodiment, $MgHO_2$ is the compound. In this example, $MgHO_2$ may be delivered by soot blowers to slag coated steam/water pipes to aid in the removal of slag. In this example, the $MgHO_2$ is suited specifically to breaking up a variety of slag accumulations caused by coal based fuels burned inside of the utility furnace.

In another exemplary embodiment magnesium is added into a utility furnace to aid in the encapsulation of harmful by products. In other exemplary embodiments, magnesium, kaolin, mullite, and/or other beneficial agents or combinations of these agents can be introduced into the utility furnace. These agents can be introduced into the utility furnace, superheats, back pass, preheats, exhaust stream, or other location to aid in the encapsulation of $SO_2$.

Figure 9:
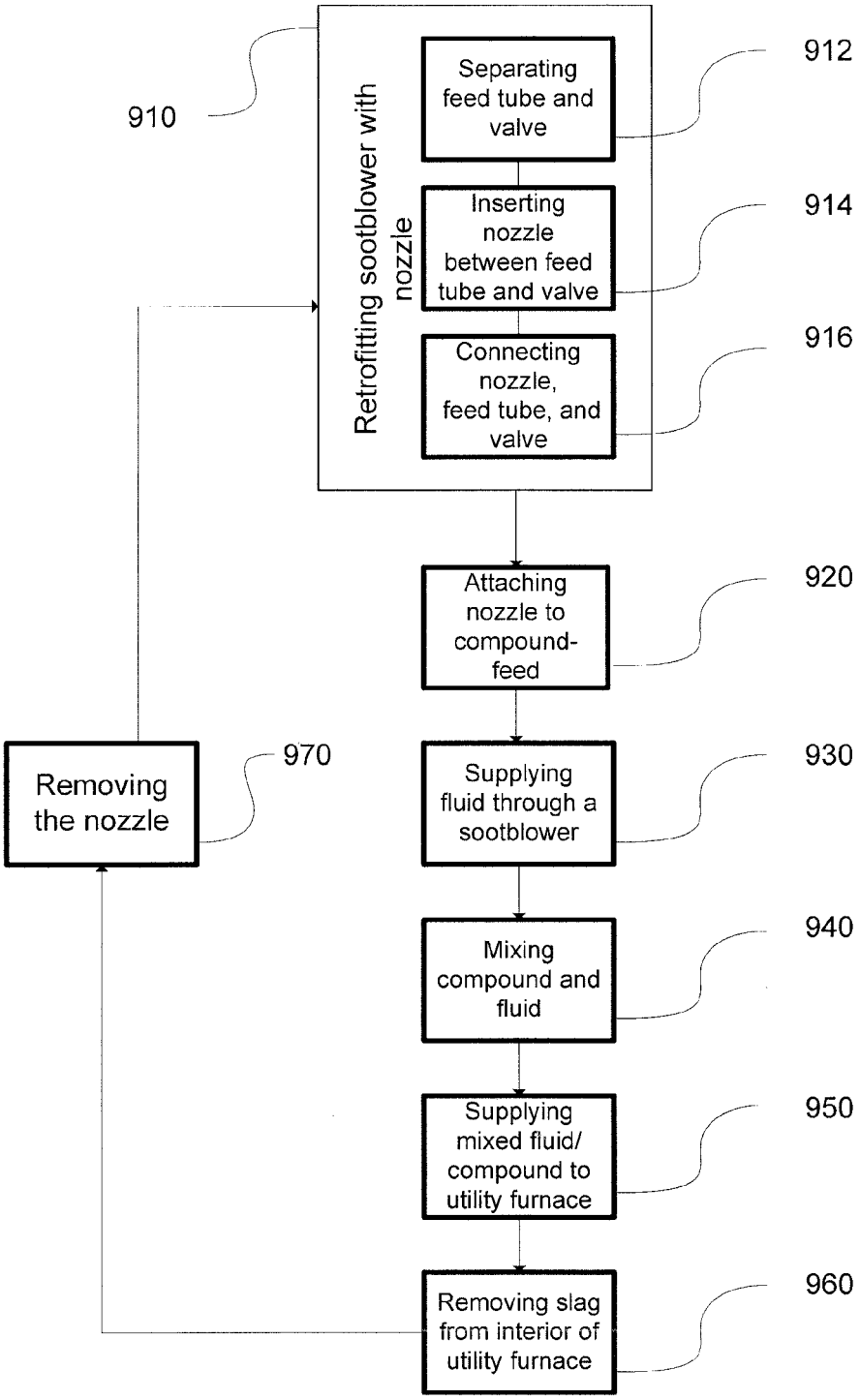
FIG. 9 is an exemplary embodiment of a method of the present invention.

In accordance with an exemplary embodiment and with reference to FIG. 9, a method is provided for introducing a solid compound into a furnace. The method comprises retrofitting a soot blower with a nozzle, such as nozzle 200 in FIG. 2 (step 910). Attaching the nozzle to a compound feed and receiving a compound into the nozzle (step 920).

Supplying a fluid through a soot blower (step 930). Mixing the compound with the fluid (step 940). Transporting the compound and fluid through a feed tube into a utility furnace (step 950). Various exemplary embodiments may further comprise, reacting the compound in the utility furnace (step 960). Furthermore, in one exemplary embodiment, the method includes removing the nozzle (which was installed in step 910) from the system (step 970).

In accordance with an exemplary embodiment, a user may retrofit the nozzle by installing it on an operational soot blower in use on any utility furnace (step 910). For example, the user may separate the poppet valve and feed tube in a soot blower (step 912) and insert a nozzle by removably connecting the nozzle between the valve and the feed tube (step 914). When separating the valve and the feed tube the fastening mechanism is removed. For example, in some commercially used soot blowers this mechanism is a 600 pound flange with four ½ in NPT studs. In accordance with various embodiments the user may need to replace the studs that originally held the feed tube and the poppet valve together. The new studs may need to be longer in order to make up the new distance added by the nozzle. For example, when placing a nozzle in-line with some commercial feed tubes and valves, 2 inch longer studs may be used. The user may reconnect the valve and the feed tube with the nozzle in between (step 916).

In accordance with an exemplary embodiment, the user may attach the nozzle to a compound feed mechanism (step 920). As discussed above the compound feed mechanism may deliver compound to the nozzle in a number of ways. In accordance with one embodiment of the present invention, the compound is drawn into the nozzle by a vacuum created at the nozzle. This vacuum may create a transport air stream. The compound may be inserted into the transport air stream in a variety of ways including but not limited to physical force (e.g., an auger), pressure, gravity, or vacuum. However, it may be possible to overload the transport air by introducing too much compound (i.e., extreme loading) or too heavy a compound. When extreme loading or moving very heavy solids occurs additional transport may be needed. As such, in accordance with another embodiment, the transport air may be pressurized coming from the compound feed. For example, the pressurized feed can come from plant instrument air and connect at the transport air valve (512 of FIG. 5 or 612 of FIG. 6) of the compound feed mechanism.

In accordance with an exemplary embodiment, fluid may be supplied through a soot blower (step 930). In one example, the fluid supply may be initiated by opening the poppet valve. In accordance with various other exemplary embodiments, the fluid supply may be initiated according to the individual operation of the soot blower or other fluid supply and delivery device.

In accordance with one embodiment of the present invention, the compound may be mixed with the pressurized fluid (step 940). In one exemplary embodiment the compound may be combined with fluid supply into a laminar flow. The compound may be control fed into the transport flow stream. In one exemplary embodiment and with exemplary reference to FIG. 6, valve 608 may be opened after the soot blower is started. Transport air is pulled by the vacuum through the compound feed mechanism into the soot blower fluid stream. Just before the soot blower injection nozzle 620 is in the correct location in the interior of the utility furnace, the compound is delivered to nozzle 602 by means of activating the compound delivery for example an auger feeder. The mixing or infusion may occur after fluid has been running through the soot blower. Due to the nozzle creating a vacuum, the peak impact pressure (i.e., the pressure designed into the soot blower system as measured at the injection nozzle 620 to allow it to effectively move ash in a furnace) may drop. In an exemplary embodiment, this pressure drop is compensated for by readjustment of the poppet valve. This compensation may thus prevent negative effects on the cooling flow of the lance tube and/or the peak impact pressure.

In accordance with one embodiment of the present invention, the mixture of pressurized fluid and compound may then be advantageously supplied to targeted portions of a utility furnace (step 950). Such locations may normally be accessible only by means of the soot blower. For example, referring to FIG. 7, various elements away from the wall may be the target. Referring to FIG. 8, the wall may be the target.

In accordance with one embodiment of the present invention, the mixture may react with the targeted elements on the interior of the furnace (step 960). Introducing the compound into a utility furnace may improve the efficiency of the furnace. This is done by chemically altering the buildup of pollution, slag, or other deleterious elements in furnace. In an exemplary embodiment, the device is configured to more easily remove the slag after first chemically reacting with the slag. In one example, this may allow the furnace to function on less fuel while maintaining substantially similar operating parameters.

In accordance with one embodiment of the present invention, the nozzles may be removed from the soot blower when finished distributing the compound into the furnace (step 970). This will restore the soot blower to its original condition. Once removed the nozzle and compound feed mechanism may be stored for use on the same soot blower or they may be moved to another soot blower. In accordance with another embodiment of the present invention, the nozzle and/or compound feed mechanism may be left in place for future use.

In the following description and/or claims, the terms coupled and/or connected, along with their derivatives, may be used. In particular embodiments, connected may be used to indicate that two or more elements are in direct physical contact with each other. Coupled may mean that two or more elements are in direct physical contact. However, coupled may also mean that two or more elements may not be in direct contact with each other, but yet may still cooperate and/or interact with each other. Furthermore, couple may mean that two objects are in communication with each other, and/or communicate with each other, such as two pieces of hardware. Furthermore, the term "and/or" may mean "and," it may mean "or," it may mean "exclusive-or," it may mean "one," it may mean "some, but not all," it may mean "neither," and/or it may mean "both," although the scope of claimed subject matter is not limited in this respect.

It should be appreciated that the particular implementations shown and described herein are illustrative of various embodiments including its best mode, and are not intended to limit the scope of the present disclosure in any way. Furthermore, the connecting lines shown in the various figures contained herein are intended to represent exemplary functional relationships and/or physical couplings between the various elements. It should be noted that many alternative or additional functional relationships or physical connections may be present in a practical system.

While the principles of the disclosure have been shown in embodiments, many modifications of structure, arrangements, proportions, the elements, materials and components, used in practice, which are particularly adapted for a specific environment and operating requirements without departing from the principles and scope of this disclosure. These and other changes or modifications are intended to be included within the scope of the present disclosure and may be expressed in the following claims.

I claim:

1. A method of removing slag within a utility furnace, the method comprising:

providing a pressurized fluid stream comprising a fluid to an inlet of a nozzle of a soot blower, wherein the fluid comprises at least one of: air, steam, and water;

providing a slag treating compound to a compound entrance of the nozzle;

mixing the slag treating compound with the pressurized fluid stream to form a mixture downstream of an exit of the nozzle, wherein the nozzle comprises a varying cross-section between the inlet and the exit, wherein the nozzle has a larger diameter cross-section opening at the inlet than at the exit to cause a pressure differential between the inlet and the exit with the pressure being higher at the inlet than at the exit for drawing the slag treating compound into the compound entrance; and delivering the mixture through the soot blower to a targeted area inside the utility furnace, wherein the targeted area includes the slag on an outside surface of one or more tubes, and wherein the soot blower is selected from the group consisting of: a wall mounted soot blower, a retractable long lance soot blower, a rotating element soot blower, a helical soot blower, and a Rake blower;

wherein the slag treating compound, in the mixture, chemically reacts with the slag to improve removal of the slag from an interior of the utility furnace, and wherein the slag is removed via a combination of a chemical reaction and a mechanical force; and wherein the method further comprises retrofitting the soot blower, wherein before the retrofitting, the soot blower could only provide the pressurized fluid stream to the inside of the utility furnace.

2. The method of claim 1, wherein the slag comprises products of combustion built up on the one or more tubes, and wherein at least a portion of the products of combustion have melted due to reaching its fusion temperature.

3. The method of claim 1, wherein the slag comprises ash slagging.

4. The method of claim 1, wherein the slag treating compound comprises one or more of: magnesium hydroxide, potassium hydroxide, sodium hydroxide, aluminum hydroxide, magnesium, kaolin, and mullite.

5. The method of claim 1, wherein the slag treating compound is magnesium hydroxide and is delivered by the soot blower to the slag that is coating the outside surface of the one or more tubes to aid in the removal of the slag from the outside surface of the one or more tubes.

6. The method of claim 1, wherein the one or more tubes comprise one of: water tubes forming portions of water walls, pipes, super heat pipes, reheat pipes, a convection section of horizontal tubes, an economizer and air preheaters.

7. The method of claim 1, wherein the utility furnace is a coal fired power plant furnace, burning pulverized coal, wherein the utility furnace further comprises a combustion chamber inside the utility furnace.

8. The method of claim 1, wherein the soot blower is a retractable soot blower, wherein the retractable soot blower comprises a feed tube and a valve, wherein the nozzle is inserted between the feed tube and the valve during the retrofitting, and wherein the retractable soot blower carries the slag treating compound into the utility furnace to the targeted area.

9. A method of removing slag from an interior of a utility furnace, the method comprising:

providing a pressurized fluid stream comprising a fluid to an inlet of a nozzle of a soot blower, wherein the fluid comprises at least one of: air, steam, and water;

providing a slag treating compound to a compound entrance of the nozzle;

mixing the slag treating compound with the pressurized fluid stream to form a compound mixture downstream of an exit of the nozzle, wherein the nozzle comprises a varying cross-section between the inlet and the exit, wherein the nozzle has a larger diameter cross-section opening at the inlet than at the exit to cause a pressure differential between the inlet and the exit with the pressure being higher at the inlet than at the exit for drawing the slag treating compound into the compound entrance;

supplying the compound mixture through the soot blower to a targeted area in the interior of the utility furnace, wherein the soot blower was originally configured solely for the removal of soot using the pressurized fluid stream without the slag treating compound but that now is configured to inject the slag treating compound in line with the pressurized fluid stream, for the removal of the slag using both a chemical reaction and a mechanical force, wherein the soot blower is selected from the group consisting of: a wall mounted soot blower, a retractable long lance soot blower, a rotating element soot blower, a helical soot blower, and a Rake blower; and retrofitting the soot blower, wherein before the retrofitting, the soot blower could only provide the pressurized fluid stream to the inside of the utility furnace.

10. A method of providing a slag treating compound into a utility furnace system through retrofitted soot blowers, the utility furnace system configured to combust a fuel within a combustion chamber, the utility furnace system having a utility furnace having tubes forming a water wall that forms at least a portion of the combustion chamber of the utility furnace, the method comprising:

retrofitting a soot blower to make a retrofitted soot blower to provide the slag treating compound into the utility furnace, the soot blower having a pressurized fluid supply attached to the soot blower for injecting a pressurized fluid into the utility furnace, the soot blower further comprising a feed tube and a valve, wherein the retrofitting comprises:

separating the feed tube and the valve and inserting and connecting a nozzle between the feed tube and the valve, wherein the nozzle further comprises an inlet, an exit and a compound entrance, wherein the nozzle is located outside of the combustion chamber of the utility furnace, and wherein the nozzle further comprises a varying cross-section between the inlet and the exit, wherein the nozzle has a larger diameter cross-section opening at the inlet than at the exit to cause a pressure differential between the inlet and the exit with the pressure being higher at the inlet than at the exit for drawing the slag treating compound into the compound entrance;

attaching a compound feed to the compound entrance of the nozzle of the retrofitted soot blower;

supplying the slag treating compound though the compound feed to the compound entrance of the nozzle of the retrofitted soot blower;

supplying the pressurized fluid, comprising at least one of steam or air, to the inlet of the nozzle of the retrofitted soot blower via the pressurized fluid supply;

mixing the slag treating compound and the pressurized fluid downstream of the exit of the nozzle of the retrofitted soot blower to form a mixture of the slag treating compound and the pressurized fluid; and delivering the mixture of the slag treating compound and the pressurized fluid onto a slag accumulation on the water wall in an interior of the utility furnace, via the retrofitted soot blower;

wherein the retrofitted soot blower is at least one of:

1) a retractable wall mounted soot blower directing the mixture, from the retractable wall mounted soot blower, in a direction generally towards the water wall at a point where the retractable wall mounted soot blower penetrates the water wall;

2) a retractable long lance directing the mixture directly into the utility furnace at multiple locations across a cross-section of the utility furnace; and 3) a rotating element soot blower directing the mixture directly into the utility furnace.

* * * * *